US005438854A

United States Patent [19]

Seraj

[11] Patent Number: 5,438,854

[45] Date of Patent: Aug. 8, 1995

[54] VARIABLE LENGTH CYCLE LOCK

[76] Inventor: Mohammad R. Seraj, 13907 Ramona Ave., Hawthorne, Calif. 90250

[21] Appl. No.: 230,015

[22] Filed: Apr. 19, 1994

Related U.S. Application Data

[63] Continuation-in-part of Ser. No. 46,140, Apr. 15, 1993, abandoned.

[51] Int. Cl.[6] ..... E05B 71/00

[52] U.S. Cl. ..... 70/38 A; 70/39; 70/53; 70/233; 70/461

[58] Field of Search ..... 70/14, 18, 19, 233, 70/24–26, 38 A, 51, 53, 39, 38 R, 38 B, 38 C, 461

[56] References Cited

U.S. PATENT DOCUMENTS

| | | | |
|---|---|---|---|
| 577,673 | 2/1897 | Wickliffe | 70/236 |
| 596,237 | 12/1897 | Damon | 70/233 |
| 2,079,578 | 5/1937 | Schlesinger et al. | 70/53 |
| 3,728,879 | 4/1973 | Best | 70/38 R |
| 3,879,721 | 4/1975 | Yereance | 70/49 |
| 4,155,231 | 5/1979 | Zane et al. | 70/18 |
| 4,171,079 | 10/1979 | Dietlein et al. | 70/58 |
| 4,379,393 | 4/1983 | Schott et al. | 70/233 |
| 4,760,718 | 8/1988 | Muramatsu et al. | 70/18 |
| 4,888,967 | 12/1989 | Kuo | 70/233 |
| 4,918,949 | 4/1990 | Newbold | 70/39 |
| 5,065,603 | 11/1991 | Kloke | 70/233 |
| 5,092,146 | 3/1992 | Wang | 70/209 |
| 5,216,902 | 6/1993 | Sagi | 70/233 |
| 5,325,689 | 7/1994 | Warner | 70/18 |

FOREIGN PATENT DOCUMENTS

| | | | |
|---|---|---|---|
| 2276210 | 1/1976 | France | 70/233 |
| 323635 | 7/1920 | Germany | 70/53 |
| 2157756 | 10/1985 | United Kingdom | 70/233 |

*Primary Examiner*—Peter M. Cuomo
*Assistant Examiner*—Darnell M. Boucher

[57] ABSTRACT

An inexpensive, easy to manufacture security device for bicycles with a telescoping U-shaped shackle which collapses sufficiently to store the lock within the frame of a small frame bicycle and capable of telescoping sufficiently to be effective in having the U-shaped shackle pass through the bicycle wheel, frame and around a stationary object. The ends of the shackle are secured by inserting into two side holes in a tubular lock bar. One end of the shackle possesses a round lateral pocket which passes over a retainer inside the lock bar to prevent removal of the shackle. The other end of the shackle possesses a square notch which engages a key actuated lock core. The shackle can be adjusted for length when secured by the lock bar or with the bar removed.

6 Claims, 4 Drawing Sheets

VARIABLE LENGTH CYCLE LOCK

This is a continuation-in-part of application Ser. No. 08/046,140 filed Apr. 15, 1993 now abandoned.

BACKGROUND OF THE PRIOR ART

Many bicycle locks use a U-shaped latch rod 2 to secure a bicycle wheel and frame to a stationary object. These locks are typically mounted with a bracket between the bicycle frame when not in use. To be effective a lock's U-shaped latch rod must be of sufficient length to pass through the bicycle wheel, frame, and around the stationary, securing object. A lock with a U-shaped latch rod of sufficient length to be practical in use, results in a lock too long, length wise, to mount within the frame of 18 inch or smaller bicycles. Therefore, several lengths of U-shaped locks are manufactured: short U-shaped latch rod locks to enable mounting within the bicycle frame of 18 inch or smaller bicycles; and, longer U-shaped latch rod locks for use with larger bicycles. The shorter U-shaped latch rod locks are of very limited use because the U-shaped latch rod is too short to pass through the bicycle wheel, frame, and around most stationery objects.

Realizing that short U-shaped latch rod locks are of little use, manufacturers have produced locks with a flexible cable as an alternative. Flexible cable locks however are awkward to store, are easy to cut by thieves and do not secure the bicycle so as to prevent falling or being scratched when locked. U-shaped latch rod locks, without the problems of the flexible cable locks, are therefore the preferred product in the marketplace.

There is, therefore, a need for a nonflexible U-shaped bicycle lock short enough to store within a bicycle frame of an 18 inch or smaller cycle but long enough to be useful and practical to secure a cycle to a stationery object.

SUMMARY OF THE INVENTION

It is the primary object of the present invention to provide a U-shaped shackle bicycle lock with a telescoping U-shaped shackle rod to enable the lock to compress to a size sufficient to mount within the frame of an 18 inch or smaller bicycle, while having the capability to telescope to a length sufficient to pass through the bicycle's wheel, frame, and around a stationary object when being used to protect the cycle from removal. Currently available devices are only able to secure a wheel or frame to a stationary object but not both.

It is another object of the present invention to provide an improved bicycle lock which is easier to use.

It is another object of the present invention to provide an improved bicycle lock which is easier to store when not in use.

It is another object of the present invention to provide one lock capable of easy use with all sizes of bicycles, eliminating the need for several sizes of locks being manufactured.

It is a further object of the present invention to provide an improved, universal size lock, which is inexpensive to provide.

BRIEF DESCRIPTION OF THE DRAWINGS

The present invention will be more fully understood by reference to the following detailed description thereof when read in conjunction with the attached drawings, and wherein:

FIGS. 4A and 5A show end views of the respective rod ends of

FIGS. 4 and 5 taken from lines B—B and C—C, respectively.

DETAILED DESCRIPTION OF THE PREFERRED EMBODIMENT

Figure 1A:
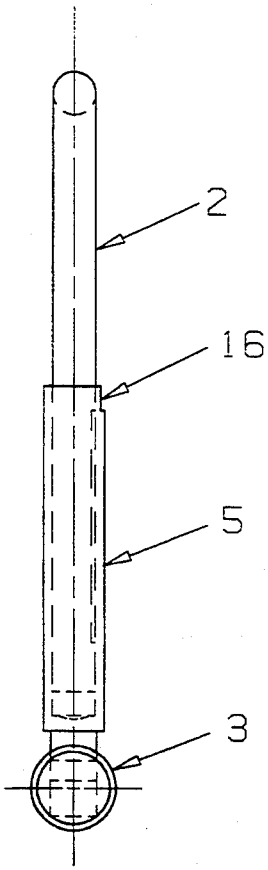
FIG. 1A shows a side view of the assembled shackle lock of FIG. 1
Figure 1:
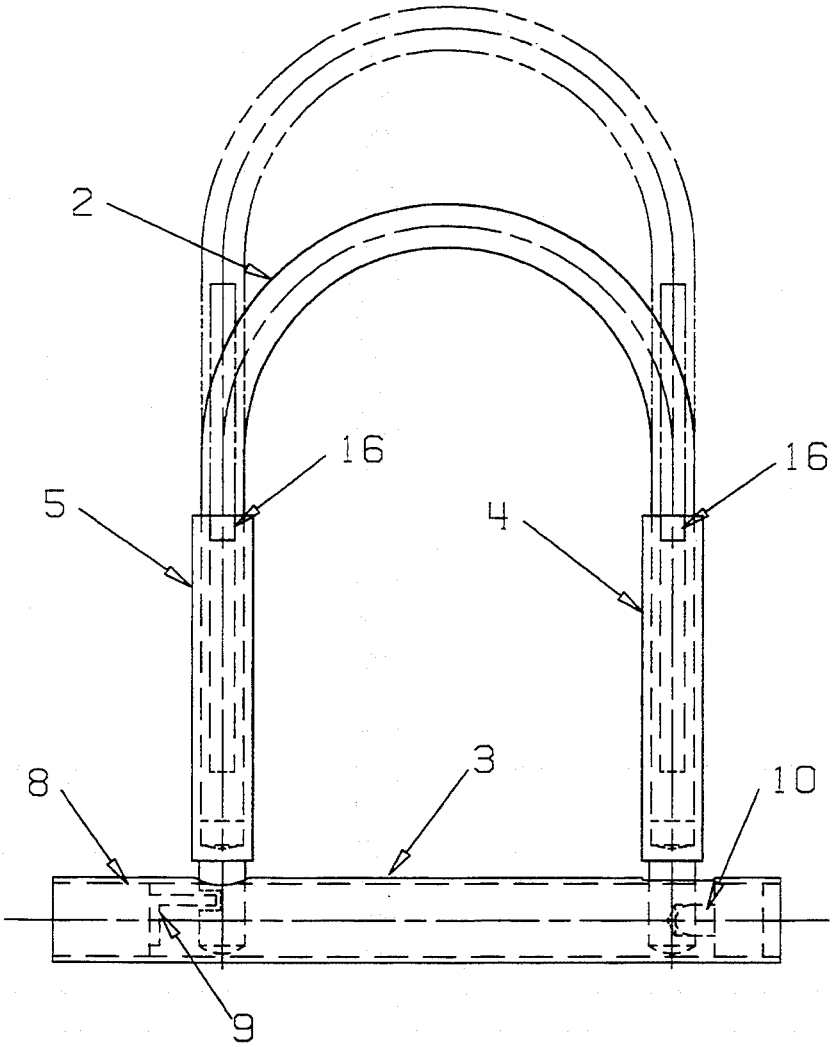
FIG. 1 is an assembled shackle lock showing each of its components, and showing the lock with its U-shaped shackle rod in both its compressed position and in its extended position.

With reference to the drawings and specifically to FIG. 1 thereof, the improved bicycle lock with its tubular lock bar 3, retaining shackle rod end 4, locking shackle rod end 5, U-shaped shackle rod 2, lock core 8, actuating member 9, and shackle retainer pin 10.

Figure 2:
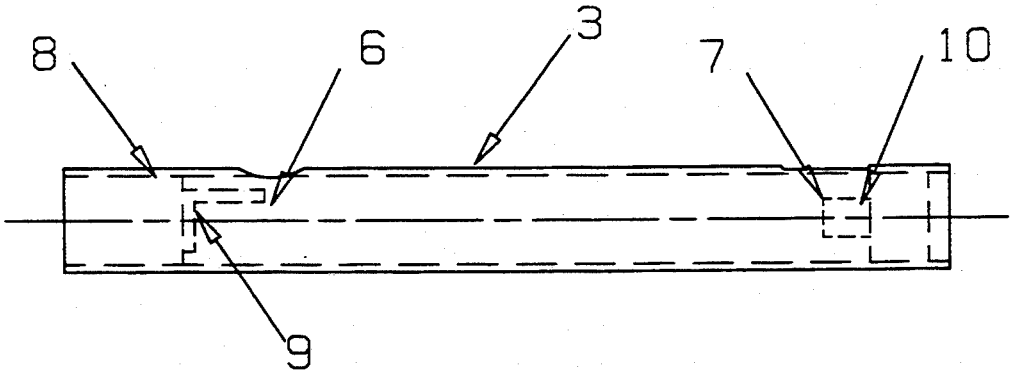
FIG. 2 shows the lock bar.
Figure 5A:
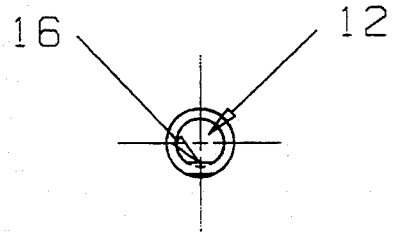

Reference now may be had to FIG. 2. The locking bar 3 has two holes, 6 and 7, perpendicular to the centerline of the tube, through one side only. Holes 6 and 7 receive the ends of shackle rod ends 4 and 5. Locking rod end 5 inserts into hole 6. Retaining rod end 4 inserts into hole 7. The end of the lock bar 3 adjacent to hole 6 contains a lock core 8 with an actuating member 9. The lock core 8 and actuating member 9 are well known in the art and will not be described hereinafter. The opposite end of the lock bar 3 tube contains the shackle retainer pin 10.

Figure 3:
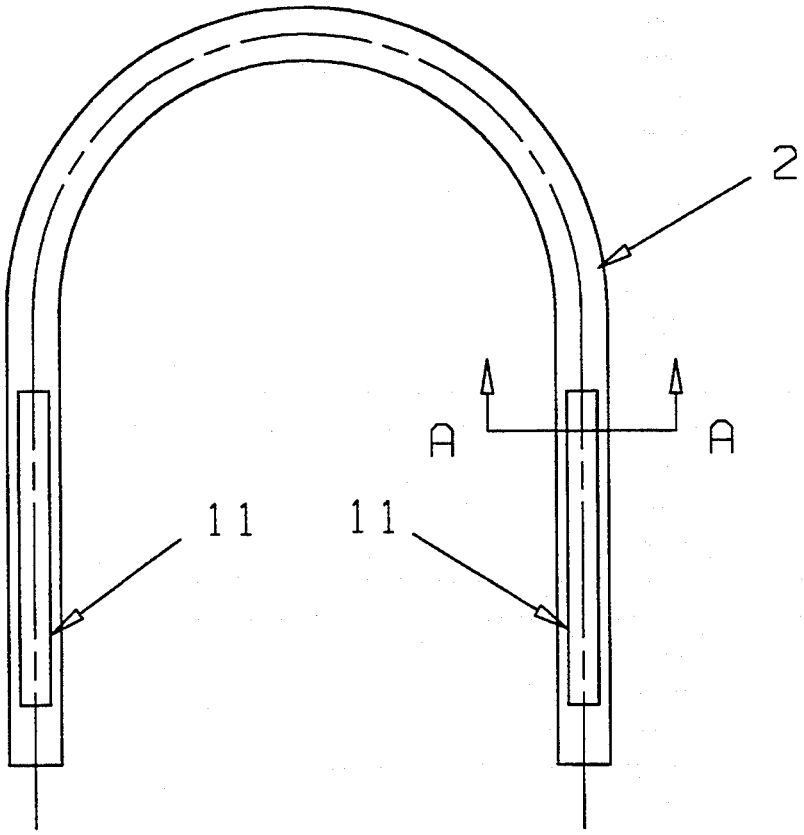
FIG. 3 shows the U-shaped .shackle rod.
Figure 3A:
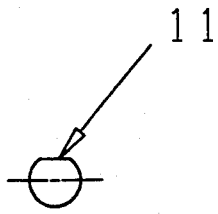
FIG. 3A shows a cross-section taken from line A—A of FIG. 3.

Reference now may be had to FIG. 3. The U-shaped shackle rod 2 is a solid rod with a round cross-section except in an area on each leg having material removed to form a flat surface 11. Each flat begins on the straight portion of each shackle rod 2 leg but terminates before reaching the end of the rod.

Figure 5:
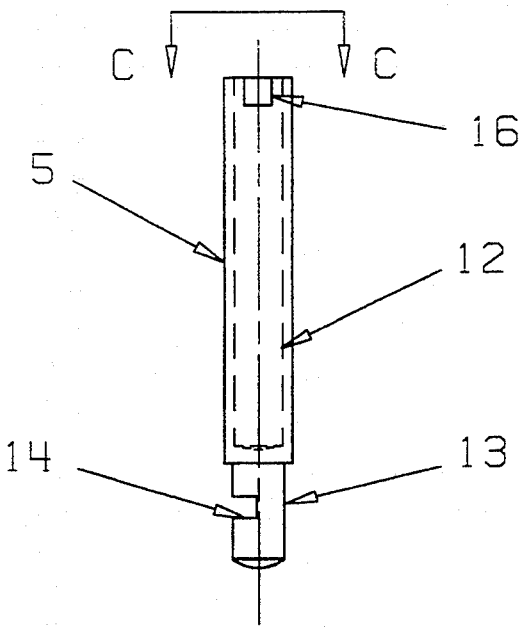
FIG. 5 shows the locking shackle rod end.

Reference now may be had to Fig. 5. The locking shackle rod end 5 has a round cross section and at one end a deep, blind hole 12 parallel to the centerline of the rod end to accept one leg of the U-shaped shackle rod 2. The opposite end is solid with a slightly smaller, concentric outside diameter 13. A squared notch 14 is cut into the smaller diameter 13 to receive the actuating member 9 and prevent removal of the shackle rod end 5 from the lock bar 3.

Reference now may be had to FIG. 5. The shackle rod end 4 has a round cross-section and at one end a deep, blind hole 12 parallel to the centerline of the rod end to accept one leg of the U-shaped shackle rod 2. The opposite end is solid with a slightly smaller outside diameter 13. Into the smaller diameter 13, perpendicular to the rod end 4 centerline, is a shallow, blind hole 15 which engages the shackle retainer pin 10.

Figure 4A:
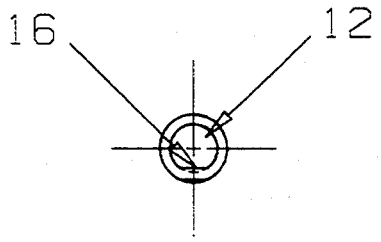
Figure 4:
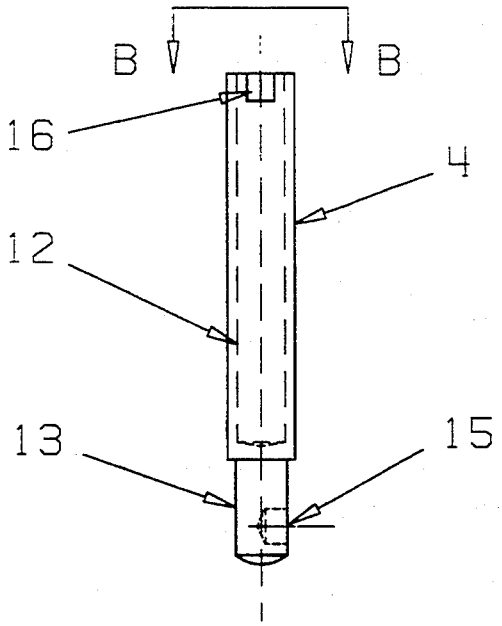
FIG. 4 shows the retaining shackle rod end.

Reference now may be had to FIG. 1 and 1A which are the front and side views of the complete lock. When in use to lock a cycle, the U-shaped shackle rod 2 is free to slide up or down in the shackle rod ends 4 and 5, effectively making the distance between the lock bar 3 and the round top of the U-shaped shackle rod 2 greater when extended and smaller when compressed. The U-shaped shackle rod 2 is prevented from disengaging from the shackle rod ends 4 and 5 by a stop 16 which is a crimp of displaced material into the inner hole 12 of each shackle rod end 4 and 5. Reference may be had to FIG. 4 and FIG. 5. The stop 16 protrudes into the space created by the flats 11 on the U-shaped shackle rod 2 legs. Thus, the stops 16 prevent the round end portion of the legs of the U-shaped shackle rod 2 from passing and allowing disengagement to occur. Once assembled, the rod end or tubes are permanently attached to the shackle 2 and are free to slide up and down the length of the shackle's legs.

When in use to lock a cycle, the U-shaped shackle rod 2 and shackle rod ends 4 and 5 is inserted through the wheel, the bicycle frame, and around a stationary object. Shackle rod end 4 is inserted into hole 7 of lock bar 3 and over shackle retainer pin Shackle rod end 5 is inserted into hole 6 of lock bar 3 with a slight compression of the shackle rod 2. With shackle rod end 5 in place, the lock core 8 is key activated and actuating member 9 engaged into notch 14. The lock of the present invention is in the locked position. When it is desired to release the lock of the present invention from the bicycle, it is necessary to insert a proper key into the lock core 8 to disengage the actuating member 9 and allow the U-shaped shackle rod 2 and shackle rod ends 4 and 5 to be separated from the lock bar 3.

When in use, the U-shaped shackle rod 2 may be telescoped to the length necessary to pass through the bicycle wheel, bicycle frame and around a stationary object. When not in use, the U-shaped shackle rod 2 may be compressed with its legs pushed into shackle rod end 4 and shackle rod end 5 so as to shorten the length of the lock for storage mounting between the frame of the bicycle.

Figure 6:
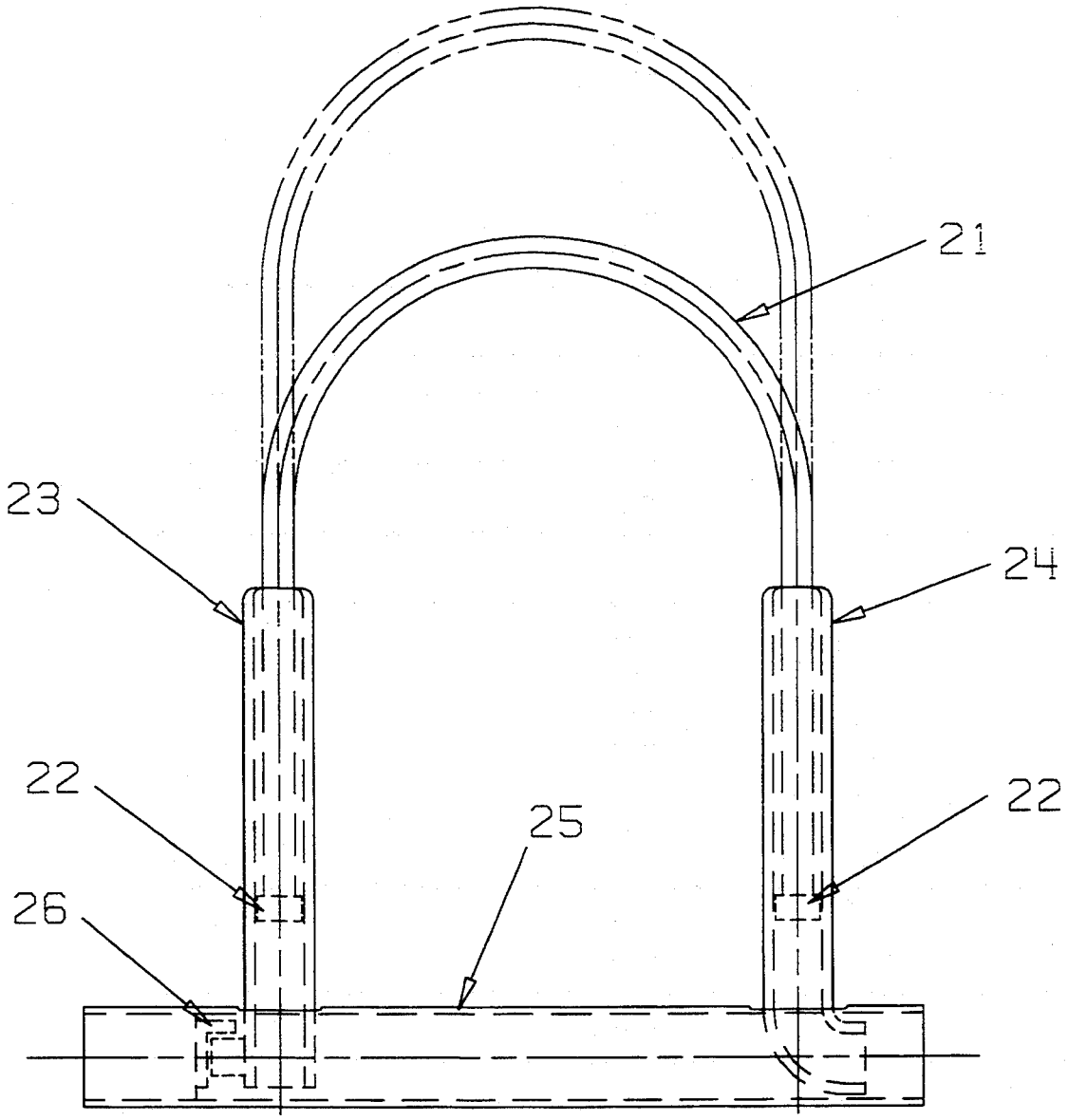
FIG. 6 shows a modified embodiment of the invention.

In a modified embodiment of the invention, as shown in FIG. 6, right tube 24 has a curved end which fits into the lock cross bar 2 and is free to turn. The curved end prevents tube 24 from being removed from cross bar 25 when the lock is in the locked position. Cross bar 25 has a key locking mechanism consisting of deadbolt 26 to prevent the shackle 23 from being removed from cross bar when the lock is in its locked position but which may be removed when the locking mechanism is unlocked. Although this dead bolt is shown, the invention contemplates numerous other locking mechanisms which are presently used in producing shackle locks. Thus, when the lock is in the locked position, tube or rod end 24 can not be pulled out of cross bar 2 because of its curved bottom and tube 23 can not be removed from cross bar 25 due to the lock dead bolt 26 preventing the tube 23 from being pulled out. In the locked position, shackle 2 can extend in length until two stops 22 formed on each leg hits the crimped end of tubes 23 and 24. Pulling out on shackle 21 causes the effective locking area to increase in size whereas pushing in on shackle 21 reduces the effective locking area.

Still other objects and advantages of the present invention will become readily apparent to those skilled in the art from the preceding detailed description. Only the preferred embodiments of the invention are illustrated and described, as afforementioned, simply by way of presenting the best modes contemplated of carrying out the invention. This invention is capable of other and different embodiments, and its several details are capable of modifications in various respects, all without departing from the invention. Accordingly, the drawings and descriptions are to be regarded as illustrative in nature, and not a restrictive, the invention being defined solely by the claims appended hereto.

I claim:

1. An improved cycle lock, comprising:

(a) a U-shaped shackle and a lock bar designed to secure across the open end of the shackle;

(b) said shackle formed with a pair of nonflexible legs, each leg having a shackle rod end permanently affixed thereto, said legs of said shackle and said rod ends having connecting means for allowing movement such that the shackle's length is adjustable, a free end of each rod end is adapted to be secured by a retaining means inside one end of the said lock bar, the other of said rod ends formed to engage a lock mechanism in the other end of said lock bar.

2. An improved cycle lock of claim 1 wherein the connecting means includes a longitudinal inner hole in a fixed end of each rod end which accepts a flat surface and stop surface formed on each of the legs of the shackle whereby the fixed ends of each rod end is subsequently crimped to permanently affix the legs to the shackle rod ends.

3. An improved cycle lock of claim 1 wherein the connecting means includes a longitudinal inner hole in a fixed end of each rod end which accepts an end portion of each leg including two stops formed on each of the legs of the shackle whereby the fixed ends of each rod end is subsequently crimped to permanently affix the legs to the shackle rod ends.

4. An improved cycle lock of claim 2 wherein the retaining means is a retaining pin engageable in a notch located in of one of the rod ends.

5. An improved cycle lock of claim 2 wherein the retaining means is a bent end portion of one of the rod ends engageable in an opening of the lock bar.

6. An improved cycle lock, comprising:

(a) a U-shaped shackle and a lock bar designed to be secured across the open end of the shackle;

(b) said shackle formed with a pair of legs, each leg having a shackle rod end permanently affixed thereto, said legs of said shackle and said rod ends having connecting means for allowing movement such that the shackle's length is adjustable;

(c) said lock bar having a pair of apertures wherein each aperture accepts a free end of each of the rod ends, each free end having securing means which engage with retaining means in the lock bar to lock the shackle to the lock bar;

(d) the securing means includes a notch on each of the free ends and the retaining means includes a retaining pin inside one end of the said lock bar, and a lock mechanism in the other end of said lock bar.

* * * * *